US005123816A

United States Patent [19]

Gilliam et al.

[11] Patent Number: 5,123,816

[45] Date of Patent: Jun. 23, 1992

[54] COMPRESSOR SUCTION NOISE ATTENUATOR AND ASSEMBLY

[75] Inventors: David R. Gilliam; Phillip S. Leonard, both of Bristol, Va.; Jackson R. Dale, Bristol, Tenn.

[73] Assignee: Bristol Compressors, Bristol, Va.

[21] Appl. No.: 679,413

[22] Filed: Apr. 2, 1991

[51] Int. Cl.[5] ..... F04B 39/00; F01N 7/18

[52] U.S. Cl. ..... 417/312; 181/403; 181/240; 181/243

[58] Field of Search ..... 417/312, 313; 181/227, 181/250, 255, 276, 273, 403, 240, 243, 269

[56] References Cited

U.S. PATENT DOCUMENTS

| | | | |
|---|---|---|---|
| 3,101,891 | 8/1963 | Frank | 417/312 |
| 3,645,358 | 2/1972 | Kubota | 417/312 |
| 3,864,064 | 2/1975 | Gannaway | 417/312 |
| 4,239,461 | 12/1980 | Elson | 417/312 |
| 4,313,715 | 2/1982 | Richardson | 417/312 |
| 4,370,104 | 1/1983 | Nelson | 417/312 |
| 4,523,663 | 6/1985 | Bar | 181/403 |
| 4,730,695 | 3/1988 | Bar | 417/312 |
| 4,755,108 | 7/1988 | Todescat | 417/312 |
| 4,784,583 | 11/1988 | Bar | 417/312 |
| 4,911,619 | 3/1990 | Todescat | 417/312 |
| 4,960,368 | 10/1990 | Lilie | 417/312 |

*Primary Examiner*—Richard A. Bertsch
*Assistant Examiner*—Peter Korytnyk

[57] ABSTRACT

A suction noise attenuator adapted for mounting on a tubular, suction conduit of a gas compressor, the conduit having a gas port through the wall thereof, the attenuator having a shell formed with generally opposed, first and second end walls and generally opposed first and second side walls, all of the walls having proximal and distal portions relative to the suction conduit, the proximal portions being resiliently deformable and the combined edges thereof providing a substantially continuous perimeter mounting face, a distal wall interconnecting the distal portions of all the walls to define an attenuation cavity, the mounting face further defining an inlet to the cavity, the edges of the end walls being concave and adapted to conform substantially to the periphery of the conduit as the attenuator is pressed thereagainst, at least one locator device on the shell adapted for coupling with at least one locator device on the conduit for operatively positioning the attenuator on the conduit to connect the port and cavity in fluid communication, and shoulders on an exterior surface of the shell adapted for retaining a clip fastening device in operative position thereon for securing the attenuator to the conduit.

22 Claims, 2 Drawing Sheets

COMPRESSOR SUCTION NOISE ATTENUATOR AND ASSEMBLY

FIELD OF INVENTION

This invention concerns novel noise attenuator construction and the assembly thereof with suction conduit means, for reducing noise resulting from suction conduit vibration, valving operation, suction gas pulsing, or the like, of piston type compressors such as hermetically sealed units used in refrigerators, heat pumps, window units, or other such applications, and particularly concerns such attenuators for use with dual piston compressors employing dual suction valving and dual suction gas feed conduit means.

DISCUSSION OF RELATED ART

The use of noise attenuators which are mounted within the suction conduit systems of hermetically sealed compressor units is of course well known as shown in U.S. Pat. Nos. 3,101,891; 3,645,358; 3,864,064; and 4,239,461, the utility disclosures of which are incorporated herein by reference. As illustrated in these disclosures, all or part of the attenuator structures are made integrally with or permanently affixed to other components of the compressor such as the motor cap, shroud or the like. Such fixed position relationship of the attenuator part or parts with the compressor unit parts necessarily requires installation of the attenuator along with major components of the compressor. For such installation therefore, stringent assembly procedures, precise component manipulations, and substantial labor time are required if the desired gas sealing and structural stability of the attenuator within the compressor suction system is to be achieved.

OBJECTS OF THE INVENTION

Objects, therefore, of the present invention are: (a) to greatly simplify the construction and assembly procedures for suction noise attenuators used in compressors, particularly in small hermetically sealed, single or multiple piston units, while providing markedly improved noise muffling; (b) to provide such attenuators with design features which readily allow their manufacture from moldable plastic materials; and to provide improved, cooperative structural design for such attenuators and suction conduits such that they can be rapidly and accurately interconnected into a suction unit having minimum weight, minimum exterior dimension, and fluid-tight, mating assembly joints.

SUMMARY OF THE INVENTION

These and other objects hereinafter appearing have been attained in accordance with the present invention through the discovery of suction noise attenuator construction providing excellent fluid sealing, physical strength, vibrational resistance, and noise muffling, the invention in a preferred embodiment being defined as a suction noise attenuator adapted for connection to the tubular, suction gas conduit means of a gas compressor unit having fluid port means through the wall thereof, comprising shell means having generally opposed end wall means and generally opposed side wall means, each of said wall means having proximal and distal portions relative to the suction conduit means, the edge means of said combined proximal portions being resiliently deformable and providing perimeter mounting face means, distal wall means interconnecting said distal portions of said end and side wall means to define attenuation cavity means, said mounting face means defining inlet means to said cavity means, said proximal edge means of said end wall means being concave and adapted to resiliently, substantially conform to the exterior wall surface of said conduit means, locator means on said shell means and adapted for association with cooperating locator means on the wall of said conduit means, and shoulder means on an exterior surface of said shell means adapted for retaining fastening means in operative position thereon for securing said attenuator to said conduit means with said port means and cavity means in fluid communication.

Certain further preferred embodiments are as follows:

(1) the end and side wall means are relatively positioned to form an attenuator cavity of substantially rectangular longitudinal cross-section;

(2) the exterior surface of said distal wall means is convex and is provided with said shoulder means longitudinally spaced thereon;

(3) the shoulder means comprises a pair of longitudinally spaced, substantially transverse ridge means;

(4) the proximal edge means of said end wall means are provided with resilient crush rib means adapted to seal tightly against said conduit means through the compressive force provided by said fastening means;

(5) the locator means on said shell means comprises at least one projection contiguous to the proximal edge means of at least one of the end wall means; and (6) the concave proximal edges of all of said wall means in their undistorted condition are concave and the major portions thereof are formed on one or more radii which is less, e.g., from about 5 to about 15% smaller, than the radius of the conduit means wall to which the attenuator is to be affixed.

BRIEF DISCRIPTION OF THE DRAWINGS

DETAILED DESCRIPTION OF THE DRAWINGS OF PREFERRED EMBODIMENTS

Figure 1:
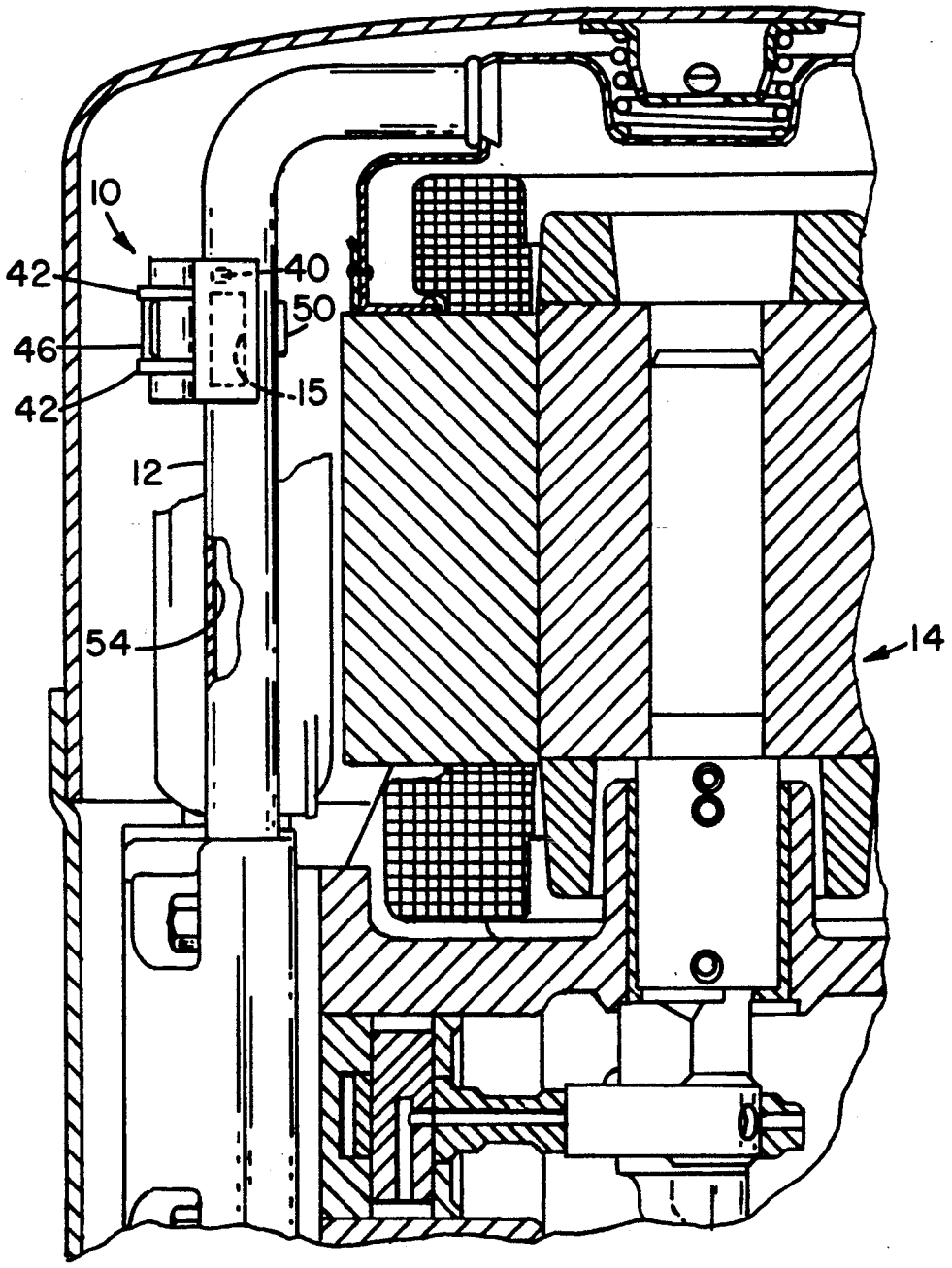
FIG. 1 is a longitudinal cross-sectional view of a portion of a typical hermetically sealed refrigeration gas-compressor with the present attenuator clip-mounted onto a cylindrical suction conduit or suction tube thereof.
Figure 2:
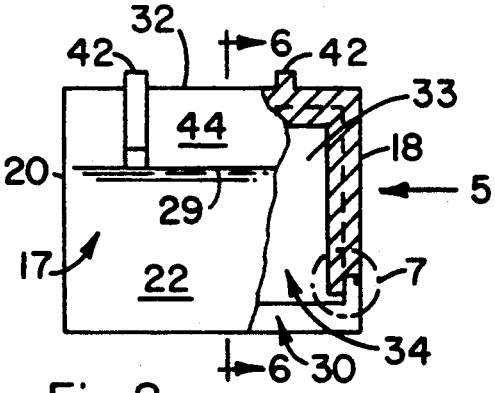
FIG. 2 is a side view of the attenuator with portions of a side wall thereof broken away for clarity.

Referring to the drawings and to the claims hereof, the present noise attenuator generally designated 10 is adapted for mounting on a tubular, suction conduit means or suction tube 12 of a gas compressor generally designated 14, the conduit means having fluid port means 15 through the wall 16 thereof, comprising shell means 17 having generally opposed, first and second end wall means 18 and 20 respectively, and generally opposed first and second side wall means, 22 and 24 respectively, all of said wall means having proximal and distal portions 26 and 28 respectively, relative to the suction conduit means, said proximal portions being resiliently deformable, the combined edge means of all said proximal portions providing substantially continuous perimeter mounting face means 30, distal wall means 32 interconnecting said distal portions of all said wall means to define attenuation cavity means 33, said mounting face means defining inlet means 34 to said cavity means, said edge means of said end wall means being concave and adapted to resiliently, substantially conform to the periphery 36 of the conduit means upon compressive engagement therewith, locator means 38 on said shell means adapted for coupling with locator means 40 on the conduit means for operatively positioning said attenuator on the conduit means with the port means 15 thereof in fluid communication with said cavity means 33, and shoulder means 42 on an exterior surface 44 of said shell means adapted for retaining fastening means 46 in operative position thereon for securing said attenuator to the conduit means.

Figure 3:
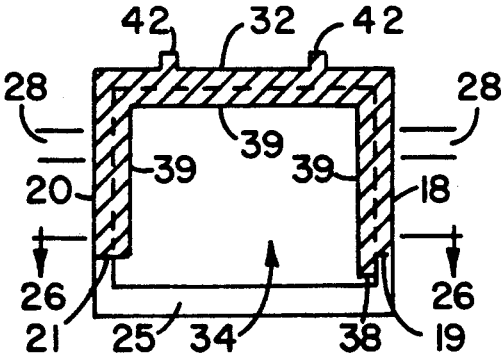
FIG. 3 is complete longitudinal sectional view of the attenuator taken through the longitudinal plane "LP" thereof.
Figure 4:
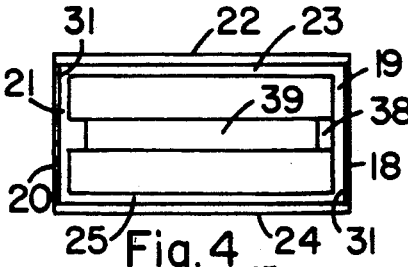
FIG. 4 is a bottom view of the attenuator.

In further detail, the attenuator 10 is manufactured from a material which provides resiliency to the proximal portions of the wall means. These portions are those lying generally below line 26—26 as viewed in FIG. 3, and further shown in FIG. 11 and designated 26 therein. The resiliency is conveniently achieved through the use of heat and oil resistant plastic material such as polyamide, polyimide, poly(vinyl chloride), and preferably heat stabilized ZYTEL 103(polyamide from Du Pont), from which the attenuator can be injected molded as a complete unit. The distal portions of the wall means are those lying generally within the region designated 28 in FIG. 3, and may be considered as terminating at their juncture 29 with distal wall means 32. The exact location of this juncture will, of course, depend on whether and how such of an arc is provided in wall means 32.

Figure 5:
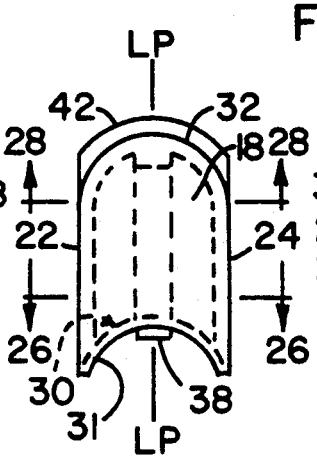
FIG. 5 is an end elevational view taken in the direction of arrow 5 in FIG. 2.
Figure 6:
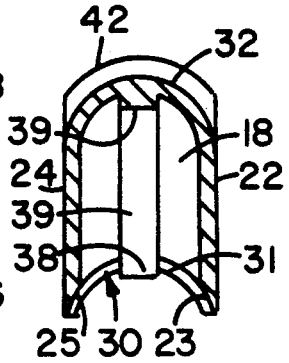
FIG. 6 is a lateral cross-sectional view taken along line 6—6 of FIG. 2 in the direction of the arrows.
Figure 7:
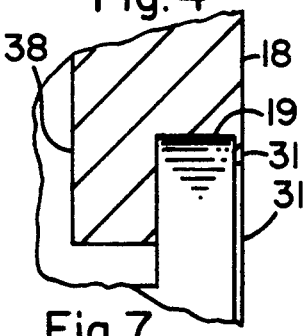
FIG. 7 is an enlarged view of the dotted outlined portion 7 of FIG. 2 showing the crush-rib structure.

The locator means 38 on the shell, in the embodiment shown in the drawings, is in the form of a key-like projection which is an extension of reinforcing rib 39 integrally formed with the shell and contiguous to an extending beyond edge means or mounting face portion 30 as shown in FIGS. 5, 6 and 7. This projection lies inwardly, i.e., on the cavity side of 30 and inwardly spaced from a crush-rib 31 which is provided on the concave outer or contact edge of both end wall means 18 and 20. Such a projection can be provided, of course, on each end of the shell. Also, the locations of the projection 38 and cooperating locator aperture or recess 40 can be reversed, i.e., the projection can be a turned-out tab on the conduit wall, and the recess can be provided in a portion of the mounting face or reinforcing rib 39.

Figure 8:
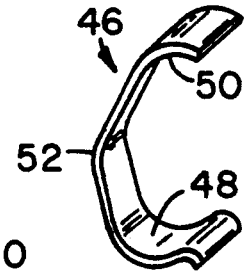
FIG. 8 is a perspective view of a preferred spring clip type of fastening means useful in the present invention.
Figure 9:
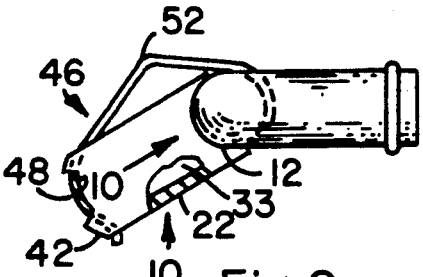
FIG. 9 is a top view of the suction tube-mounted attenuator taken in the direction of arrow 9 in FIG. 1 with portions of the top end wall and shoulder means of the attenuator broken away for clarity.
Figure 11:
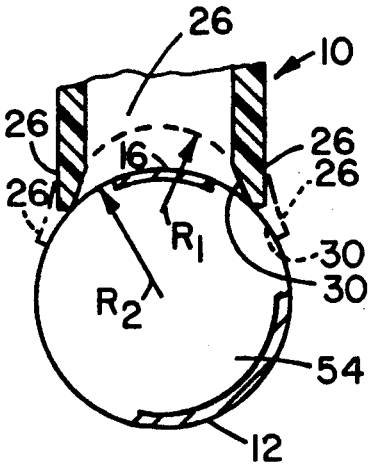
FIG. 11 is an exaggerated geometric illustration of the sealing mechanism and posture of the proximal edge means of the attenuator as compressed against the wall of the conduit means.
Figure 10:
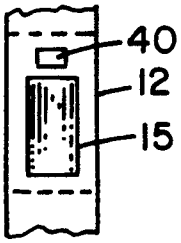
FIG. 10 is an elevational view of the conduit of FIG. 9 taken in the direction of arrow 10, and showing the port means (aperture) and locator means (aperture) through the wall of the conduit.

The crush-ribs are quite thin, e.g., preferably from about 0.001 to about 0.005 inches, and extend outwardly from the mounting face, preferably a distance of from about 0.010 to about 0.030 inches such that they are sufficiently flexible to crush against the suction conduit wall and seal the shell ends thereagainst through the compressive force of a simple fastener such as the spring clip 46 shown in FIGS. 1, 8 and 9. In this regard, as shown in FIG. 11 of approximately double the typical attenuator dimensions, the initial radius or radii "$R_1$" of the mounting face means which is comprised of both crush-ribs 31, the concave contact edges 19 and 21 of the first and second end wall means respectively, and the concave contact edges 23 and 25 of the first and second side wall means respectively, all of which are part of the aforesaid proximal portions 26, is increased to radius or radii "$R_2$" through compression and spreading of the mounting face against the conduit wall 16. This compression also will have flexibly distorted the proximal wall portions 26 as shown by the dotted lines and further insures a substantially gas-tight fit of the attenuator against the conduit wall. The use of two or more different radii for the mounting face is sometimes preferable provided each radius "$R_1$", is smaller than "$R_2$" which is the radius of the conduit wall. The relative dimensions and positioning of the attenuator mounting face 30, conduit port 15, and locator aperture 40 should be such that port 15 and aperture 40 lie well inside of the mounting face to insure a proper sealing thereof within the perimeter of cavity inlet 34.

The fastening means 46 is preferably of a resilient, metal spring clip type as shown in FIGS. 1, 8 and 9, and comprises opposing first gripping or hooking element 48 engaging shell means 17, especially distal wall means 32 thereof, and operatively positioned thereon between shoulders 42, and second gripping or hooking element 50 engaging conduit means 12, and further comprising a contractive-power generating bend 52 connecting the hooking elements into a unit and exerting, in its partially straightened and stressed condition, a substantial contractive force therebetween. In place of bend 52, other contractive-power generating means such as a coiled extension spring or a turnbuckle coupling connected at its ends to one each of the hooking elements can be employed.

The particular configuration of the present attenuator and its dimensions relative to the conduit gas passage 54 and port means 15, provide unexpected, markedly reduced, tuned suction noise attenuation, particularly for dual cylinder compressors having dual suction conduits. In this regard, a highly effective, and preferred set of operating and structural parameters (ranges) for such a dual cylinder compressor and attenuator combination, is as follows:

(1) cylinder (individual) capacity, 12 to 25 $cm^3$;
(2) suction conduit (individual) capacity 10 to 25 $cm^3$
(3) total suction refrigerant flow rate (average), 250 to 450 lbs/hr;
(4) fluid port means (15) flow area, 0.6 to 4.0 $cm^2$;
(5) inlet means (34) flow area, 2.0 to 5.0 $cm^2$; and
(6) cavity means (33) volume, 3.5 to 7.5 $cm^3$.

It has been found that operating within the above parameter ranges, for dual cylinder, twenty eight thousand Btu compressor, and tuned at 1,000 to 2,000 hertz, the suction noise level is readily maintained at between about 50 to about 60 db, and in general, gives at least about a five db reduction. It is noted that the substantially rectangular, longitudinal cross-sectional configuration of the attenuator is preferred, however, one may operate satisfactorily within the above parameters employing differently shaped attenuator shells, e.g., an elongated oval configuration, the continuous mounting face of which may be provided with continuous crush-rib means therearound.

This invention has been described in detail with particular reference to preferred embodiments thereof, but it will be understood that variations and modifications will be effected within the spirit and scope of the invention.

I claim:

1. A suction noise attenuator adapted for mounting on tubular, suction conduit means of a gas compressor, the conduit means having fluid port means through the wall thereof, said attenuator comprising shell means having generally opposed, first and second end wall means and generally opposed first and second side wall means, all of said wall means having proximal and distal portions relative to the suction conduit means, said proximal portions having resiliently deformable edge means the combined edge means of all said proximal portions providing substantially continuous, perimeter mounting face means, distal wall means interconnecting said distal portions of all said wall means to define attenuation cavity means, said mounting face means defining inlet means to said cavity means, said edge means of said end wall means being concave and adapted to resiliently, substantially conform, under pressure, to the periphery of the conduit means, locator means on said shell means adapted for coupling with locator means on the conduit means for operatively positioning said attenuator on the conduit means with said port means in fluid communication with said cavity means, and shoulder means on an exterior surface of said shell means adapted for retaining a fastening means in operative position thereon for securing said attenuator to the conduit means.

2. The attenuator of claim 1 wherein said cavity means is substantially rectangular in longitudinal cross-section.

3. The attenuator of claim 2 wherein the exterior surface of said distal wall means is convex and is provided with said shoulder means.

4. The attenuator of claim 3 wherein said shoulder means comprises a pair of longitudinally spaced, substantially transverse ridge means.

5. The attenuator of claim 1 wherein the concave edge means of said end wall means are provided with resilient crush-rib means adapted to form a gas-tight seal against said conduit means upon being forced thereagainst.

6. The attenuator of claim 5 wherein said locator means is contiguous to the edge means of at least one of said end wall means.

7. The attenuator of claim 1 wherein the concave edges of both said end wall means are formed substantially on the same radius.

8. The attenuator of claim 6 wherein said locator means comprises projection means extending from an interior portion of at least one of said end wall means to beyond the mounting face portion formed thereby, said projection means lying inwardly of said crush-rib means and spaced therefrom.

9. The attenuator of claim 7 wherein the edge means of both said side wall means are also formed substantially on said radius.

10. The attenuator of claim 9, formed of resilient material, is mounted on tubular suction conduit means of a gas compressor wherein the radius of all said edge means prior to mounting the attenuator on the conduit means, and with said edge means in relaxed condition, is smaller than the radius of the wall means of said conduit means such that forced engagement of said edge means with said wall means during said mounting will expand the perimeter of said mounting face means and conform it to the surface of said wall means to seal thereagainst.

11. A suction noise attenuator for mounting on tubular, suction conduit means of a gas compressor, wherein the conduit means has a fluid port means through the wall thereof, comprising shell means having wall means providing attenuation cavity means having inlet means bordered and formed by arcuate, resiliently deformable, perimeter edge means of said wall means and adapted to conform substantially in configuration to the outer surface of the conduit means on which the attenuator is to be mounted, projection means on said shell means extending beyond said edge means and inwardly thereof toward said cavity means, and adapted for insertion into recess means in the wall of said conduit means for positioning said attenuator in operative position on said conduit means with said port means in fluid communication with said cavity means, and shoulder means on exterior surface portions of said shell means adapted for retaining fastening means in said position thereon for securing said attenuator in a compressive, sealing manner to said conduit means.

12. The attenuator of claim 11 wherein said cavity means is substantially rectangular in longitudinal cross-section.

13. The attenuator of claim 12 wherein said shoulder means is provided on exterior surface portions of said shell means positioned generally opposite from said inlet means of said cavity means.

14. The attenuator of claim 13 wherein said shoulder means comprises a pair of longitudinally spaced ridge means.

15. The attenuator of claim 11 wherein all of said edge means is formed substantially on the same radius which is smaller than the radius of the outer wall surface of the conduit means to which the attenuator is to be attached.

16. The attenuator of claim 15 compression mounted on the tubular suction conduit means wherein the compressive engagement of said edge means with said conduit means has deformed said perimeter edge means to increase the radius thereof and conform it essentially to the radius of the conduit means and seal said cavity means to said conduit means.

17. The attenuator-conduit means assembly of claim 16 wherein the compression mounting of said attenuator on said conduit means is provided by a resilient clip comprising opposing first gripping means engaging said shell means and operatively positioned thereon by said shoulder means, and second gripping means engaging said conduit means, and further comprising contractive-power generating means connecting said first and second gripping means and exerting substantial contractive force therebetween.

18. The attenuator-conduit means assembly of claim 16 wherein said perimeter edge means is provided with resilient crush rib means providing a compression seal against said conduit means, and said conduit means is provided with fluid port means through the wall means thereof and placing said cavity means and the fluid passage of said conduit means in fluid communication.

19. A gas compressor having at least one tubular suction conduit means connecting suction gas plenum means to suction gas inlet means of compressor cylinder means, said conduit means being provided with fluid port means through the wall means thereof, a suction noise attenuator mounted on said conduit means and comprising shell means having generally opposed end wall means and generally opposed side wall means, each of said wall means having proximal and distal portions relative to the suction conduit means, the edge means of said proximal portions providing substantially continuous, perimeter mounting face means, distal wall means interconnecting said distal portions of all said wall means to define attenuation cavity means, said edge means of said end wall means being concave and resiliently stressed, and substantially conforming to the periphery of said conduit means, locator means on said shell means associated with cooperating locator means in the wall means of said conduit means and positioning said attenuator on said conduit means such that said port means is in fluid communication with said cavity means, and shoulder means on an exterior surface of said shell means and retaining fastening means thereon in operative position securing said attenuator to said conduit means with compressive force.

20. The compressor of claim 19 wherein the compression mounting of said attenuator on said conduit means is provided by a resilient clip comprising opposing first gripping means engaging said shell means and operatively positioned thereon by said shoulder means, and second gripping means engaging said conduit means, and further comprising contractive-power generating means connecting said first and second gripping means and exerting substantial contractive force therebetween.

21. The compressor of claim 19 wherein said edge means of said end wall means are provided with resilient crush-rib means providing enhanced compressive, gas sealing against said conduit means.

22. The compressor of claim 21 wherein said cooperating locator means comprises projection means on said shell means and aperture means in the wall of said conduit means, said projection and aperture means being located cavity-side inwardly of said mounting face means.

* * * * *